US006244908B1

(12) United States Patent
Hammond et al.

(10) Patent No.: US 6,244,908 B1
(45) Date of Patent: Jun. 12, 2001

(54) SWITCH WITHIN A DATA CONNECTOR JACK

(75) Inventors: Bernie Hammond; Terry Ward, both of Cordova; Ian Rubin De La Borbolla, Memphis, all of TN (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/632,446

(22) Filed: Aug. 4, 2000

(51) Int. Cl.[7] ..... H01R 24/00

(52) U.S. Cl. ..... 439/676; 439/188; 439/955; 200/51.03; 200/536

(58) Field of Search ..... 439/676, 955, 439/188, 170; 200/51.03, 51.05, 51.06, 51.07, 536, 533, 551

(56) References Cited

U.S. PATENT DOCUMENTS

| | | | | |
|---|---|---|---|---|
| 4,699,443 | * | 10/1987 | Goodrich et al. | 439/188 |
| 5,096,442 | | 3/1992 | Arnett et al. | 439/676 |
| 5,169,346 | | 12/1992 | Johnston | 439/676 |
| 5,244,402 | | 9/1993 | Pasterchick et al. | 439/217 |
| 5,269,708 | | 12/1993 | DeYoung et al. | 439/676 |
| 5,382,182 | | 1/1995 | Shen et al. | 439/676 |
| 5,387,135 | | 2/1995 | Shen et al. | 439/676 |
| 5,415,570 | | 5/1995 | Sarkissian | 439/676 |
| 5,626,497 | * | 5/1997 | Bouchan et al. | 439/676 |
| 5,772,466 | | 6/1998 | Morin et al. | 439/489 |
| 5,971,813 | | 10/1999 | Kunz et al. | 439/676 |
| 6,156,981 | * | 12/2000 | Ward et al. | 439/188 |

* cited by examiner

*Primary Examiner*—Brian Sircus
*Assistant Examiner*—Hae Moon Hyeon
(74) *Attorney, Agent, or Firm*—G. Andrew Barger

(57) ABSTRACT

The data connector of the present invention securably receives at least two distinct types of mating connector plugs having different contact arrangements. The data connector includes a housing having a mating connector receiving cavity partially defined by a rear wall. The data connector further includes a printed circuit board (PCB) positioned within the housing cavity wherein the PCB has a plurality of signal contacts electrically coupled thereto and extending from a top surface thereof. The signal contacts, which are used to frictionally engage mating contacts in the plugs, are desirably arranged in at least two vertically spaced rows to accommodate the distinct plug configurations. Mounted behind a back surface of the PCB, the data connector includes cable termination assemblies for receiving and terminating individual conductors of a multiconductor cable. The conductors are electrically connected to the signal contacts via an electrical trace on the PCB. In order to change the configuration of the signal contacts to accommodate different mating connectors, the present invention data connector includes a slidable switch device along a top surface of the PCB for selectively electrically connecting the signal contacts to the conductors of the multiconductor cable via the PCB logic. Slidable movement of the switch from its initial position to a second position on the PCB accommodates the contact arrangement of the second mating plug connector, ensuring that the signal contacts are correctly configured for the appropriate mating connector that is currently in use.

29 Claims, 6 Drawing Sheets

SWITCH WITHIN A DATA CONNECTOR JACK

FIELD OF THE INVENTION

The present invention relates generally to an apparatus that establishes electrical communication between a data connector and a multiconductor cable. More particularly, the present invention is directed to a high-speed data connector capable of accommodating mating connector plugs of varying configurations and allows switching between at least two distinct cabling configurations without effecting a change in connector configuration or location.

BACKGROUND OF THE INVENTION

The integration of computers and computer-driven devices in contemporary society has elevated the role of the computer as a necessary tool for business, communication and recreation. As computers are called upon to support numerous, complementary tasks in commercial and residential environments, it has become imperative for multiple devices to communicate with one another so as to accomplish the desired tasks within a short duration. Such devices can establish electrical communication with one another via a plurality of well-established methods, such as internet or intranet connections that are established by ubiquitous standard telephone wires, Ethernet connections or operating systems that are Ethernet-compatible (i.e., token ring, fiber distributed data interface (FDDI), asynchronous transfer mode (ATM) and the like).

The efficiency of any communication system and/or network is directly dependent upon the integrity of the connector scheme employed therein. Reliability, connection integrity and durability are important considerations, since wiring life cycles typically span periods of ten to twenty years. In order to properly address performance specifications for telecommunications connecting hardware, several industry standards have been established that specify multiple performance levels of twisted pair and unshielded twisted pair (UTP) cabling components, such as those promulgated by the International Organization for Standardization (ISO) and the International Electrotechnical Commission (IEC). In order for a connector to be qualified for a given performance category, it must meet all applicable transmission requirements regardless of design or intended use. A typical means for establishing the requisite communication connections is a telecommunications jack that receives a mating connector plug from a computer.

For high-speed applications, two commonly used connection systems are Category 6 and Category 7 cabling. Transmission characteristics for Category 6 cables are specified up to 250 MHz over 100 ohm twisted pairs, making Category 6 a good choice for generic applications. Category 6 cabling delivers the highest level of transmission performance available without individually screened pairs, resulting in the emergence of cable and connecting hardware configurations that are tuned to one another to achieve optimum performance. Yet as manufacturers have configured mated modular plug-and-jack combinations to work together to cancel cross-talk, incompatible cross-talk cancellation technologies from different plug and jack makers can put an entire operating system at risk of falling below the Category 6 specifications.

Transmission characteristics for Category 7 cabling are specified up to 600 MHz over 100 ohm twisted pairs. Unlike the Category 6 plugs, the Category 7 plugs provide shielding between each pair of signal paths within the jack so as to reduce cross talk. Category 7 components support many applications over twisted pair cabling as well as those that require fibers or coaxial cables. Category 7 cabling is fully shielded with individually screened twisted pairs and an overall shield, enabling superior performance and bandwidth at a fraction of the cost of fiber. The fully shielded construction of Category 7 cable results in a larger outside diameter and less flexibility than UTP, requiring greater care in the design of pathways and termination spaces to allow for more space and larger bend radii. Fully shielded solutions that incorporate Category 7 cabling are applicable in environments with significant ambient noise (i.e. broadcast stations), or where radiated emissions must be minimized. Category 7 cabling is further applicable in information intensive industries that require high-speed data exchange to obtain competitive advantages. Residential and commercial buildings can also implement Category 7 cabling as a single cable type that serves all copper cabling requirements with improved performance and reduced costs. Since each individual pair is shielded, Category 7 channels eliminate cross-talk noise between pairs, allowing Category 7 components to support multiple applications over one cable. Global acceptance of this standard has been impaired, however, by connecting components that are limited in terms of performance, ease of use, adaptability and size: Category 7 cabling requires connectors to provide at least 60 dB of cross-talk isolation between all pairs at 600 MHz, a requirement that is 20 dB more severe than Category 6 cabling at 250 MHz.

A standard jack that is used with high-speed connection lines (such as those associated with Category 6 and Category 7 cabling) is an RJ45 connector. The RJ45 connector allows interconnection with an eight-contact data cable and has the advantage of transferring more data in a given duration. Category 6 plugs, for instance, have a row of eight (8) contacts on the upper portion of the jack to connect with corresponding contacts in the plug. Category 7 connector system plugs have four (4) separate pairs of contacts, each pair located in a corner of the Category 7 plug housing so that that cross-talk between contact pairs is reduced upon separation from one another. An RJ45 jack having eight (8) contacts may therefore be used to connect either a Category 6 or a Category 7 cable.

Currently, a consumer has to choose either a Category 6 connection system or Category 7 connection system. The process of changing from one system to another requires changing both the connector plug and jack, introducing extreme difficulty, expense and inconvenience when a switch between cabling types is desirable due to the demands of the cabling application. This is particularly evident if the jack is installed inside of a wall or other structure that is not readily obvious or mutable.

It is therefore desirable to provide a connector jack that can be used with either a Category 6 or Category 7 mating connector plug without modifying the connector jack itself. There is a continuing need for improved outlet connectors that fulfill both Category 6 and Category 7 performance requirements in order to satisfy the increasing bandwidth requirements of communication systems and networks. Accordingly, the connector used to terminate category 6 and 7 cabling must accommodate the transfer of data signals between jacks and plugs without significant loss of efficiency.

SUMMARY OF THE INVENTION

It is an advantage of the present invention to provide a data connector that can accommodate mating connector plugs of varying configurations.

It is another advantage of the present invention to provide a data connector that selectively switches between Category 6 and Category 7 cabling without making any adjustments to the connector.

It is yet another advantage of the present invention to substantially reduce the requisite number of components required for assembly of a switchable data connector.

It is still another advantage of the present invention to provide a data connector wherein all contacts are open while the connector is switched from category 6 cabling to category 7 cabling, thereby eliminating the possibility of shorting category 6 contacts to category 7 contacts.

In the efficient attainment of these and other advantages, the present invention provides a data connector in the form of a jack that accommodates at least two distinct types of mating connectors in the form of a plug. The data connector of the present invention securably receives at least two distinct types of mating connector plugs having different contact arrangements. The data connector includes a housing having a mating connector receiving cavity partially defined by a rear wall. The data connector further includes a printed circuit board (PCB) positioned within the housing cavity wherein the PCB has a plurality of signal contacts electrically coupled thereto and extending from a top surface thereof. The signal contacts, which are used to frictionally engage mating contacts in the plugs, are desirably arranged in at least two vertically spaced rows to accommodate the distinct plug configurations. Mounted behind a back surface of the PCB, the data connector includes cable termination assemblies for receiving and terminating individual conductors of a multiconductor cable. The conductors are electrically connected to the signal contacts via an electrical trace on the PCB. In order to change the configuration of the signal contacts to accommodate different mating connectors, the present invention data connector includes a slidable switch device along a top surface of the PCB for selectively electrically connecting the signal contacts to the conductors of the multiconductor cable via the PCB logic. Slidable movement of the switch from its initial position to a second position on the PCB accommodates the contact arrangement of the second mating plug connector, ensuring that the signal contacts are correctly configured for the appropriate mating connector that is currently in use.

DETAILED DESCRIPTION OF THE PREFERRED EMBODIMENTS

The present invention provides a data connector jack for a multiconductor cable that receives at least two distinct types of mating connector plugs having different contact arrangements. The data connector includes a housing having a receiving cavity for a mating connector plug wherein the cavity has a printed circuit board (PCB) positioned therewithin. The PCB has a plurality of signal contacts that frictionally engage mating contacts in at two distinctly configured mating connector plugs. The signal contacts are desirably arranged in at least two vertically spaced rows to accommodate the two distinct plug configurations. The data connector further includes cable termination assemblies for receiving and terminating individual conductors of the multiconductor cable. The conductors are electrically connected to the signal contacts via an electrical trace on the PCB. In order to change the configuration of the signal contacts to accommodate different connector plug designs, the data connector of the present invention provides a slidable switch for selectively establishing an electrical connection between the signal contacts and the conductors of the multiconductor cable via the PCB logic.

Figure 1:
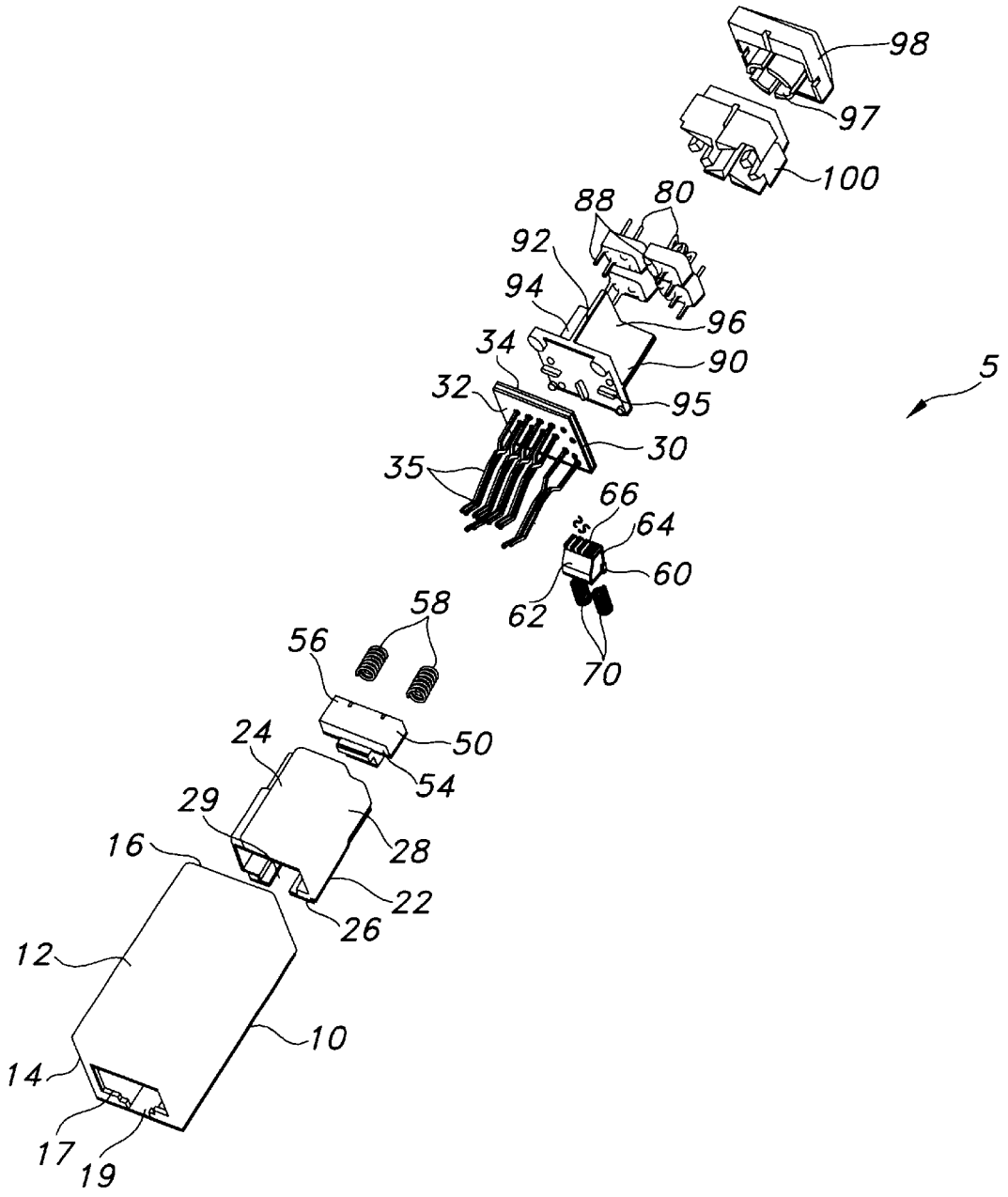
FIG. 1 is an exploded perspective view of a data connector formed in accordance with the present invention.

Now referring to the figures wherein like elements are identically numbered, a preferred embodiment of a data connector 5 of the present invention is shown in FIG. 1. Data connector 5 is desirably a jack for terminating a multiconductor cable. Data connector 5 receives at least two distinct types of mating connectors, each having a different contact configuration. The two types of mating connectors shown and referenced herein are Category 6 and Category 7 plugs, however, it is understood that data connector 5 is adaptable to accommodate a variety of mating connectors without departing from the scope of the invention.

Data connector 5 includes an external housing 10 having a peripheral wall 12 coextensive with a front extent 14 and a rear extent 16. Front extent 14 defines an aperture 17 thereat through which a mating connector enters a receiving cavity 19 within the interior of housing 10. Receiving cavity 19 is adapted to securably accept a correspondingly sized and shaped mating connector therein. Housing 10 is preferably made from a die-cast, conductive material that shields connector 5 from external electrical sources. Although housing 10 is shown as a generally rectangular structure, it is understood that any geometry conducive to the operation of this invention can be utilized.

Data connector 5 further includes an interior housing 22 insertable within receiving cavity 19. Housing 22 includes a top surface 24, a bottom surface 26 and a peripheral sidewall 28 extending therebetween having a predetermined wall thickness. Housing 22 securably fits within receiving cavity 19 and accommodates insertion of a mating connector plug in a correspondingly configured recess 29 defined therewithin. Housing 22 is preferably fabricated of an insulative plastic material that is easily molded to accommodate a variety of mating connector plug configurations.

Figure 2:
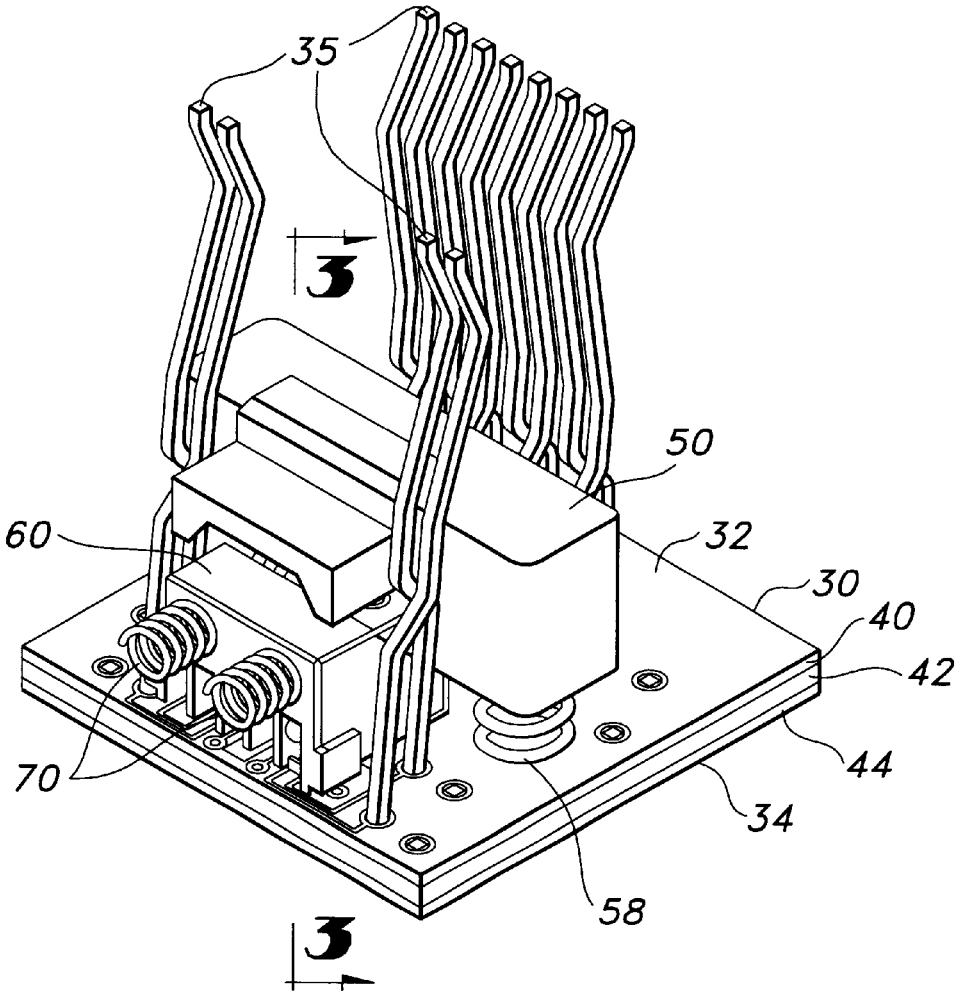
FIG. 2 is a top perspective view of a printed circuit board of the data connector of FIG. 1 supporting a switch mechanism, a carriage and a plurality of contacts thereon.

Referring further to FIGS. 1 and 2, a printed circuit board (PCB) 30 is positioned within housing 10 that includes a support surface 32 from which a plurality of signal contacts 35 longitudinally depend. Contacts 35 are electrically coupled to PCB 30 and are desirably arranged adjacent to one another in vertically spaced rows as shown so that each signal contact of a mating connector plug will have a corresponding signal contact 35 in electrical communication therewith. For instance, eight signal contacts may be provided in a single row to accommodate the signal contacts on a Category 6 connector (see FIG. 2). Similarly, four additional contacts may be spaced apart from each other in pairs and parallel to the eight signal contacts to accommodate the signal contacts on a Category 7 plug (see FIG. 2). A Category 6 plug generally includes eight contacts arranged in a row while unused signal contacts in a corresponding jack are left open. A Category 7 plug desirably includes four pairs of signal contacts situated in four comers of the connector such that four unused contacts along a top row remain open when the plug is connected with the jack.

Figure 4:
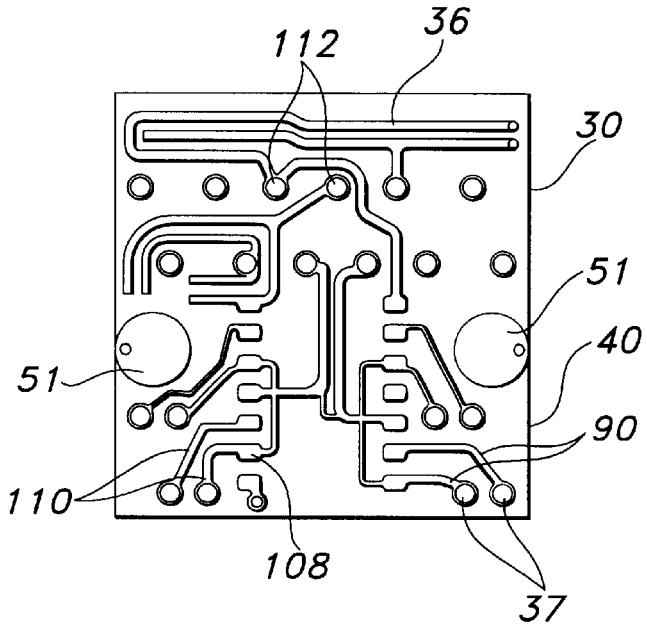
FIG. 4 is a side view of the printed circuit board of FIG. 2.

Still referring to FIG. 1 and referring further to FIGS. 2 and 4, a switch 50 is slidably mounted along support surface 32. Switch 50 enables selective electrical connection of signal contacts 35 to conductors of a multiconductor cable (not shown) via the PCB logic. Switch 50 includes each of a front switch surface 54 and a rear switch surface 56 wherein front surface 54 is positioned at a rear wall of housing cavity 19. An abutment 55 normally protrudes from front surface 54 for engagement with a mating connector plug positioned thereadjacent (see FIGS. 5 and 6). At least one switch spring 58 biases switch 50 away from support surface 32 and toward aperture 17. Spring 58 is desirably fabricated from a resilient material having one end contacting rear switch surface 56 and a second end contacting PCB 30.

Figure 3:
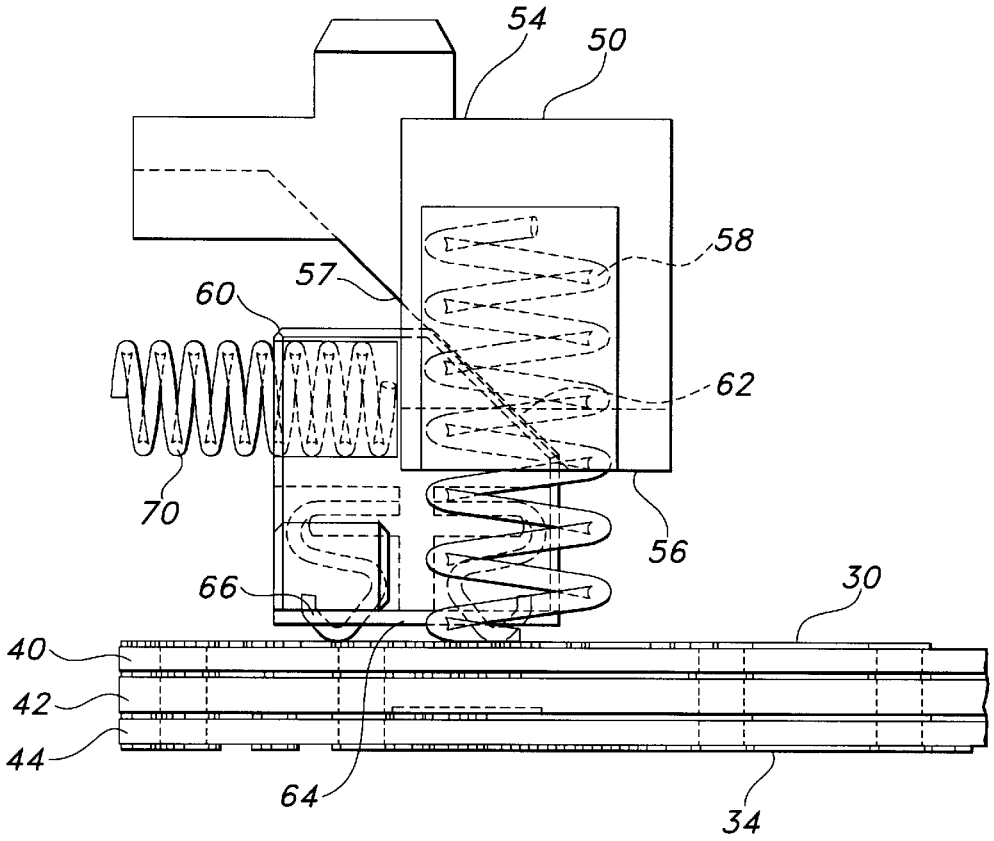
FIG. 3 is a cross-section of the printed circuit board of FIG. 2 taken through line 3—3.

Still referring to FIGS. 1, 2 and 4, a carriage 60 is positioned beneath front switch surface 54 that includes an inclined upper surface 62 and a lower surface 64. Upper surface 62 slidably engages a sloped surface 57 of front surface 54 having a slope desirably at an angle less than 90 degree. Upper surface 62 has a mating sloping surface (as particularly seen in FIG. 3) such that upon application of force upon front surface 54 in a direction towards PCB 30, carriage 60 is correspondingly translated along support surface 32. A plurality of contacts 66 are positioned on lower surface 64 of carriage 60 and slidably coupled with exposed electrical traces 36 defined on PCB 30 (shown in FIG. 4A and described hereinbelow). Contacts 66 function as a jumper to electrically connect designated signal contacts to terminated conductors of a multiconductor cable via the PCB logic. In addition, at least one carriage spring 70 is positioned substantially perpendicular to lower surface 64 so as to bias carriage 60 away from an interior surface of wall 12 of housing 10. Desirably, at least one pair of carriage springs 70 is provided (as shown in FIG. 1) that is made of a resilient material that can securely hold carriage 60 in place.

Figure 4A:
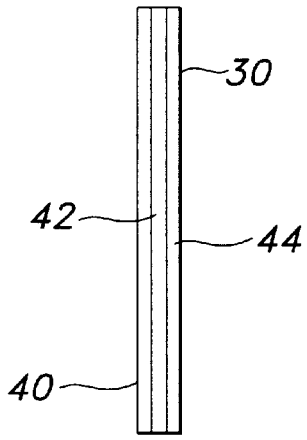
FIG. 4A is a top plan view of a top layer of the printed circuit board of FIGS. 2 and 3A.

As further illustrated in FIGS. 2, 4 and 4A, PCB 30 desirably includes multiple layers of non-conductive material, for instance, a top layer 40, a middle layer 42 and a bottom layer 44. Layers 40, 42 and 44 have multiple electrical traces or imprints 36 provided thereon to create a circuit board logic (hereinafter referred to as "PCB logic). Electrical traces 36 are configured to connect contacts 35 with at least two distinct types of mating connector plugs and to further ground any unused contacts so as to prevent shorting caused by inadvertent contact therewith. The advantage of using multiple layers is that the PCB logic, which may be very large and complex, can be compressed into a smaller form to fit inside housing 10, providing an efficient and compact circuit board thereby.

FIG. 4A particularly illustrates top layer 40 of PCB 30 having a plurality of apertures 37 therethrough. Apertures 37 are desirably plated with an electrically conductive material and connected to a plurality of contact pads 108 by a corresponding plurality of electrical imprints 110. Contact pads 108 are desirably fabricated from an electrically conductive material so that exposed surfaces thereof selectively electrically engage contact members 66 on carriage 60. PCB 30 also includes a plurality of signal contact holes 112 that are desirably plated with an electrically conductive material. Signal contacts 35 are connected to PCB 30 via insertion of the signal contacts therethrough and soldering the signal contacts in place.

Middle layer 42 of PCB 30 forms a ground plane upon which a switch spring area 51 is defined. Area 51 electrically contacts switch springs 58 and grounds them to middle layer 42. As is known in the art, increased capacitance creates undesirable interference that may degrade the electrical signal in the signal contacts. This configuration thereby reduces the amount of capacitance that may be created by switch springs 58 when they are in close proximity to signal contacts 35.

PCB 30 further includes a bottom surface 34 from which a plurality of cable termination devices 80 securably depends. Termination devices 80 may include one or more conventional cable termination devices such as insulation displacement contacts (IDC) 85 or the like as illustrated in FIG. 2. Termination devices 80 receive and terminate individual conductors of a multiconductor cable. Devices 80 are secured to PCB 30 via one or more contact pins 88 to electrical traces 36 thereon.

A shield assembly 90 is positioned between bottom surface 34 of PCB 30 and cable termination devices 80. Shield assembly 90 includes a cross member 92 that extends between respective pairs of termination devices 80 to provide cross-talk shielding therebetween. Cross member 92 is defined by a vertical shield extent 94 and a horizontal shield extent 96 that together extend outward from a substantially planar surface 95 adjacent surface 34. Cross member 92 extends through gaps among termination devices 80 to a cable entry opening 97 defined within an end cap 98. Entry opening 97 is adapted to receive at least one multiconductor cable therein. In this configuration, assembly 90 contacts end cap 98 to achieve complete shielding of signal contacts 35. The use of the shield assembly 90 thereby reduces cross talk among termination assemblies 80 by shielding paired discrete conductors from one another. It is desirable that shield assembly 90 is fabricated from an electrically conductive material to further reduce cross talk among signal contacts 35.

A dressing block is provided for receiving discrete conductors of a multiconductor cable. Dressing block 100, which aligns and holds the conductors for IDCs 85 with termination devices 80, cooperates with an end cap 98 to form a terminating extent for data connector 5. The outer sheath and metallic shielding of the multiconductor cable are securely maintained between end cap 98 and dressing block 100. End cap 98 provides strain relief for the multiconductor cable and grounding for the cable shield. End cap 98 is desirably fabricated from a conductive material so as to maintain the continuity of the shielding of the multiconductor cable from the cable to data connector 5. The strain relief for the cable and the continuity of the cable shielding is maintained by the assembly of dressing block 100 with end cap 98 connected to external housing 10.

Figure 5:
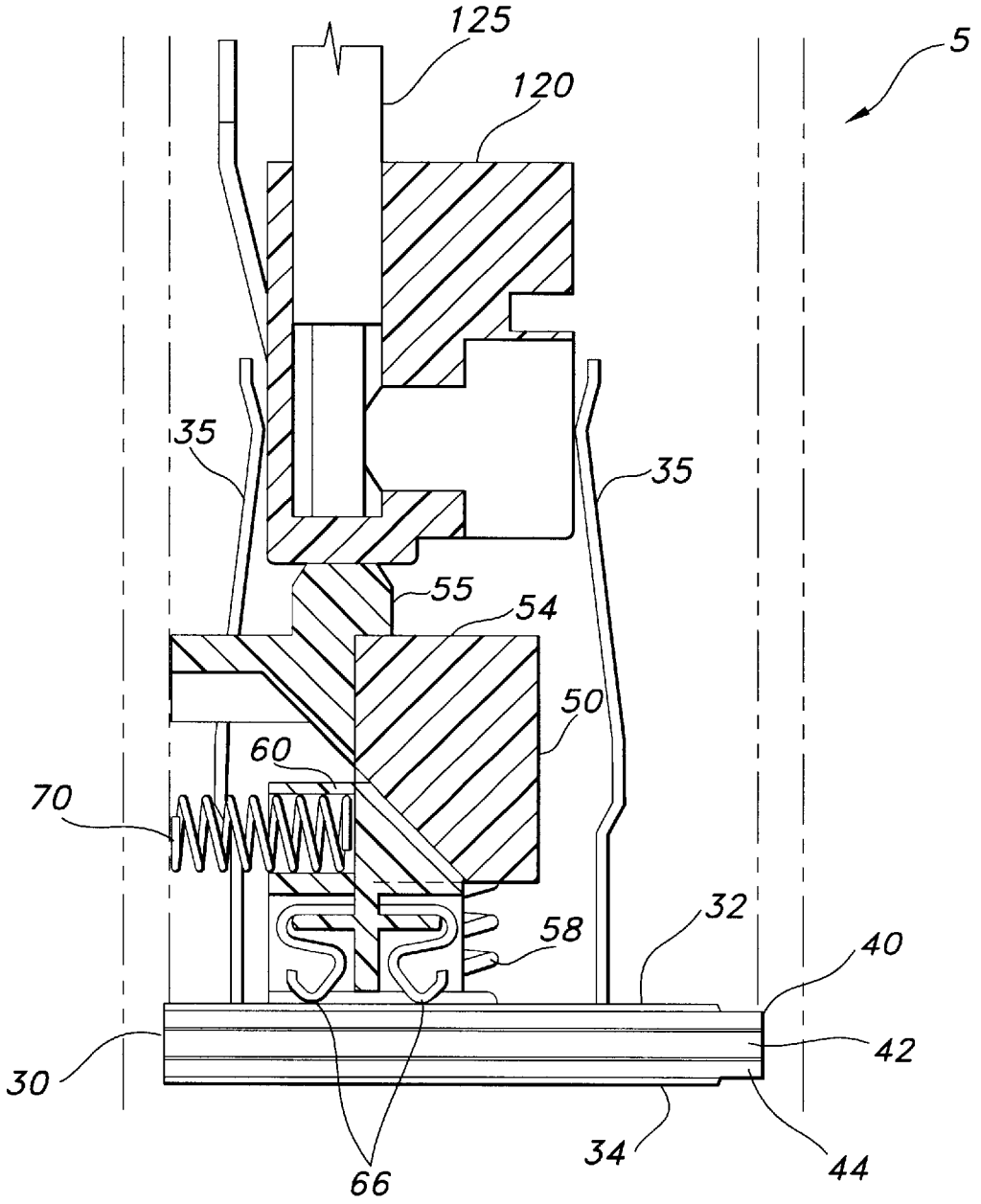
FIG. 5 is a cross-section of a first mating connector plug frictionally engaged by adjacent signal contacts upon insertion thereof into the data connector of FIG. 1.

In operation, data connector 5 is in an initial setting that is configured to insertably accept a first mating connector plug 120 (i.e., a Category 6 connector) therein as illustrated in FIG. 5. Adjacent signal contacts 35 frictionally engage plug 120 therebetween such that plug 120 contacts abutment 55 without depressing springs 58 toward PCB 30. Carriage 60 is simultaneously positioned on electrical trace 36 so that contacts 66 are placed on corresponding contact pads 108, thereby configuring corresponding signal contacts 35 with plug 120. Insertion of plug 120 into receiving cavity 19 does not impart sliding translation to carriage 60, for when carriage 60 moves along PCB 30, contacts 66 electrically contact different portions of electrical trace 36 and thereby change the configuration of signal contacts 35 to cable termination devices 80. Correct configuration of signal contacts 35 relative to the mating connector plug received in data connector 5 is therefore assured.

Figure 6:
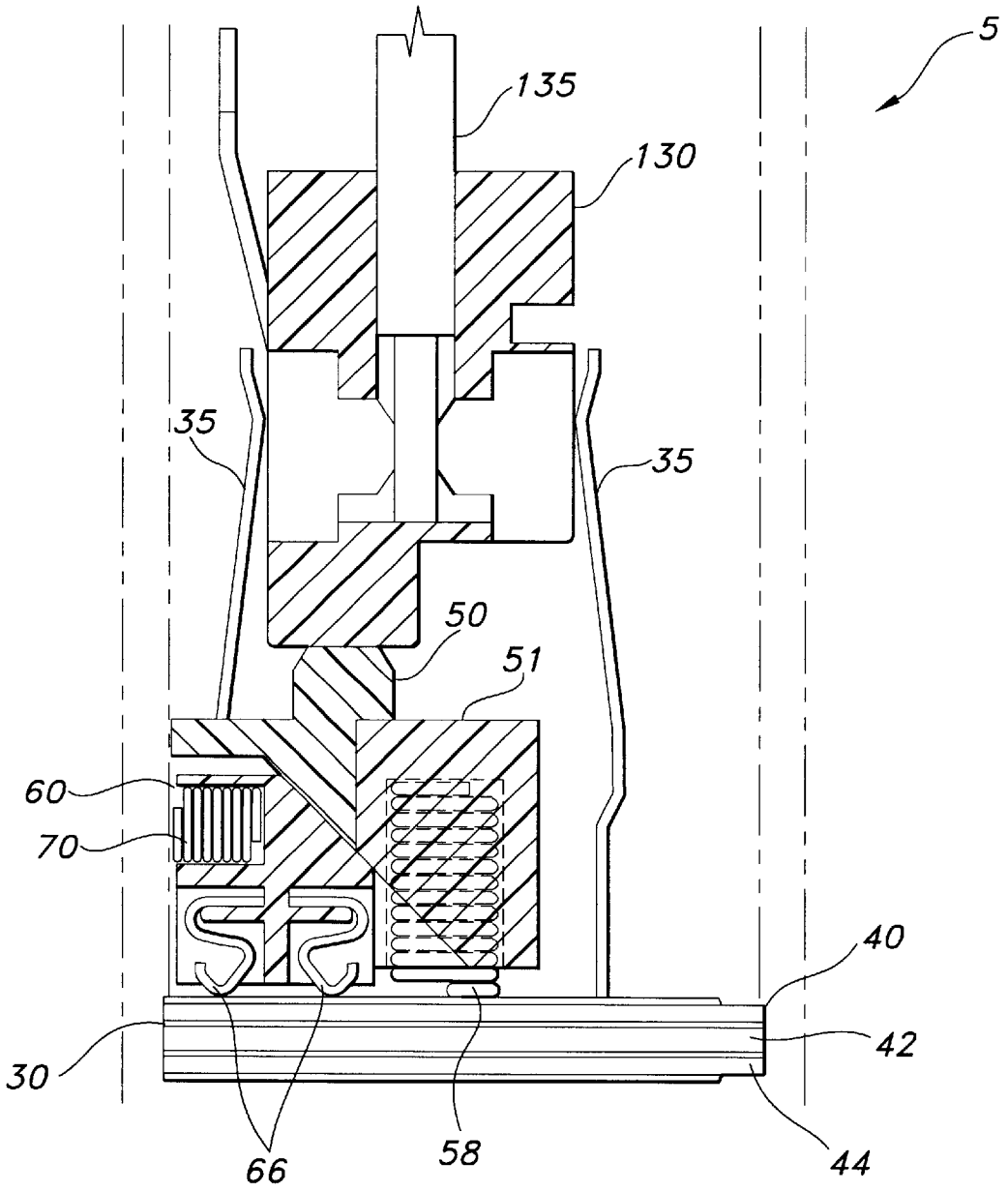
FIG. 6 is a cross-section of a second mating connector plug frictionally engaged by adjacent signal contacts upon insertion thereof into the data connector of FIG. 1.

A second carriage position is realized when a second mating connector plug (i.e., Category 7) 130 receiving a multiconductor cable 135 therein is inserted in data connector 5 as is shown in FIG. 6. When plug 130 is inserted into receiving cavity 19 between adjacent signal contacts 35, plug 130 engages abutment 55, thereby depressing switch springs 58 toward top surface 32 of PCB 30. Vertical downwards movement of plug 130 simultaneously effects engagement of sloped surface 57 with inclined upper surface 62. Contacts 66 therefore slidably move on top surface 32 from the initial position to the second position. Contacts 66 maintain mechanical and electrical communication with contact pads (not shown) on top surface 32 as carriage 60 slides therealong, depressing carriage spring 70 against a wall. Carriage 60, via horizontal reciprocating motion relative to PCB 30, reconfigures signal contacts 35 so as to leave those signal contacts associated with plug 120 as open circuits and simultaneously connect those signal contacts associated with plug 130 accordingly to reconfigure data connector 5 for plug 130.

In both the first position as shown in FIG. 5 and the second position as shown in FIG. 6, unused contacts are "left open" by the PCB logic, thereby preventing the undesirable shorting of electrical connections and associated problems with data transfer. Data connector 5 automatically changes the configuration of contacts 35 based upon the configuration of a mating connector plug inserted therein. In this manner, a user does not have to take any other actions to reconfigure the data connector other than inserting the appropriate plug.

Various changes to the foregoing described and shown methods and corresponding structures would now be evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A data connector for establishing electrical communication with a multiconductor cable wherein said data connector receives at least first and second distinct types of mating connector plugs therein, said data connector comprising:

an external housing having a peripheral wall coextensive with a front extent and a rear extent, wherein said front extent defines an aperture thereat through which a mating connector enters a receiving cavity defined within said external housing, said receiving cavity securably accepting a correspondingly sized and shaped mating connector therein;

an interior housing insertable within said receiving cavity, said interior housing having a top surface, a bottom surface and a peripheral sidewall extending therebetween having a predetermined wall thickness, wherein said interior housing securably fits within said receiving cavity and accommodates insertion of a mating connector plug in a correspondingly configured recess defined therewithin;

a printed circuit board positioned within said external housing that includes a support surface from which a plurality of signal contacts longitudinally depend, wherein said signal contacts are electrically coupled to said printed circuit board;

a switch slidably mounted along said support surface having a front switch surface and a rear switch surface wherein said front switch surface is positioned at a rear wall of said receiving cavity and wherein said switch enables selective electrical connection of said signal contacts to conductors of a multiconductor cable; and a carriage positioned beneath said front switch surface that includes an inclined upper surface and a lower surface having a plurality of contacts positioned thereon;

such that upon application of force upon said front switch surface in a direction toward said support surface of said printed circuit board, said carriage is correspondingly translated along said support surface.

2. The data connector of claim 1 wherein said printed circuit board includes multiple layers of non-conductive material for compression of a large and complex printed circuit board logic inside said external housing.

3. The data connector of claim 2 wherein said layers include a top layer, a middle layer and a bottom layer.

4. The data connector of claim 3 wherein said layers have multiple exposed electrical traces provided thereon to create said printed circuit board logic and connect said signal contacts with at least two distinct types of mating connector plugs.

5. The data connector of claim 4 wherein said carriage contacts are slidably coupled with said electrical traces upon translation of said carriage along said support surface.

6. The data connector of claim 3 wherein said top layer includes a plurality of apertures defined therethrough.

7. The data connector of claim 6 wherein said apertures are plated with an electrically conductive material and connected to a plurality of contact pads by a corresponding plurality of electrical imprints.

8. The data connector of claim 7 wherein said contact pads are desirably fabricated from an electrically conductive material so that exposed surfaces thereof selectively electrically engage said carriage contacts.

9. The data connector of claim 2 wherein said printed circuit board includes a plurality of signal contact holes through which said signal contacts are connected to said printed circuit board.

10. The data connector of claim 9 wherein said signal contact holes are plated with an electrically conductive material.

11. The data connector of claim 1 wherein said front switch surface is a sloped surface.

12. The data connector of claim 11 wherein said sloped surface has a slope of less than 90 degree.

13. The data connector of claim 11 wherein said inclined upper surface slidably engages said sloped surface upon translation of said carriage along said support surface.

14. The data connector of claim 1 further including at least one carriage spring positioned substantially perpendicular to said carriage lower surface so as to bias said carriage away from an interior surface of said external housing peripheral wall.

15. The data connector of claim 1 further including an abutment normally protruding from said front switch surface for engagement with a mating connector plug positioned thereadjacent.

16. The data connector of claim 1 further including at least one switch spring having one end contacting said rear switch surface and a second end contacting said printed circuit board to bias said switch away from said support surface and toward said aperture.

17. The data connector of claim 1 wherein said signal contacts are arranged adjacent to one another in vertically spaced rows so that each contact of a mating connector plug will have a corresponding signal contact in electrical communication therewith.

18. The data connector of claim 17 wherein eight signal contacts are provided in a single row to accommodate contacts on a mating Category 6 connector plug.

19. The data connector of claim 18 wherein four additional contacts are spaced apart from one another in pairs and parallel to said eight signal contacts to accommodate contacts on a mating Category 7 connector plug.

20. The data connector of claim 1 wherein said external housing is fabricated from a die-cast, conductive material that shields said data connector from external electrical sources.

21. The data connector of claim 1 wherein said interior housing is fabricated from an insulative plastic material that is easily molded to accommodate a variety of mating connector plug configurations.

22. The data connector of claim 1 wherein said printed circuit board includes a bottom surface from which a plurality of cable termination devices securably depends for receiving and terminating individual conductors of a multiconductor cable.

23. The data connector of claim 22 wherein said termination devices include one or more insulation displacement contacts.

24. The data connector of claim 22 wherein said termination devices are secured to said printed circuit board by at least one contact pin depending longitudinally therefrom.

25. The data connector of claim 22 wherein a shield assembly is positioned between said bottom surface and said termination devices.

26. The data connector of claim 25 wherein said shield assembly includes a cross member that extends between respective pairs of said termination devices to provide cross-talk shielding therebetween and is defined by a vertical shield extent and a horizontal shield extent that together extend outward from a substantially planar surface adjacent said bottom surface.

27. The data connector of claim 25 wherein said shield assembly is fabricated from an electrically conductive material to further reduce cross talk among said signal contacts.

28. The data connector of claim 22 further including a dressing block for receiving discrete conductors of a multiconductor cable.

29. The data connector of claim 28 wherein said dressing block cooperates with an end cap to form a terminating extent for said data connector.

* * * * *